US010683560B2

(12) United States Patent
Blumenau et al.

(10) Patent No.: US 10,683,560 B2
(45) Date of Patent: Jun. 16, 2020

(54) COLD-ROLLED AND RECRYSTALLIZATION ANNEALED FLAT STEEL PRODUCT, AND METHOD FOR THE PRODUCTION THEREOF

(71) Applicants: ThyssenKrupp Steel Europe AG, Duisburg (DE); ThyssenKrupp AG, Essen (DE)

(72) Inventors: Marc Blumenau, Dortmund (DE); Jörg Steinebrunner, Duisburg (DE); Udo Zocher, Selm (DE)

(73) Assignees: ThyssenKrupp Steel Europe AG, Duisburg (DE); ThyssenKrupp AG, Essen (DE)

( * ) Notice: Subject to any disclaimer, the term of this patent is extended or adjusted under 35 U.S.C. 154(b) by 197 days.

(21) Appl. No.: 15/518,167

(22) PCT Filed: Sep. 9, 2015

(86) PCT No.: PCT/EP2015/070577
§ 371 (c)(1),
(2) Date: Apr. 10, 2017

(87) PCT Pub. No.: WO2016/055227
PCT Pub. Date: Apr. 14, 2016

(65) Prior Publication Data

US 2017/0306430 A1 Oct. 26, 2017

(30) Foreign Application Priority Data

Oct. 9, 2014 (EP) ..... 14188314

(51) Int. Cl.
*C21D 8/04* (2006.01)
*C22C 38/04* (2006.01)
(Continued)

(52) U.S. Cl.
CPC ..... *C21D 8/0436* (2013.01); *C21D 8/0442* (2013.01); *C21D 8/0473* (2013.01);
(Continued)

(58) Field of Classification Search
CPC ..... C21D 2211/005; C21D 8/0436; C21D 8/0442; C21D 8/0473; C21D 9/46;
(Continued)

(56) References Cited

U.S. PATENT DOCUMENTS 4,775,599 A 10/1988 Matsuoka
2002/0148536 A1* 10/2002 Nakajima ..... C22C 38/002 148/320

(Continued)

FOREIGN PATENT DOCUMENTS

CN 101956133 A 1/2011
CN 102453837 A 5/2012

(Continued)

OTHER PUBLICATIONS

Temper Rolling of Sheet Steel, V.L. Mazur (Year: 2012).*

(Continued)

*Primary Examiner* — Colleen P Dunn
*Assistant Examiner* — Anthony M Liang
(74) *Attorney, Agent, or Firm* — The Webb Law Firm

(57) ABSTRACT

A cold-rolled and recrystallization-annealed flat steel product may include a ferritic microstructure, which possesses optimized formability and suitability for a wide variety of applications, including painting, for example. The flat steel product may include a steel comprising (in percent by weight): C: 0.0001%-0.003%, Si: 0.001%-0.025%, Mn: 0.05%-0.20%, P: 0.001%-0.015%, Al: 0.02%-0.055%, Ti: 0.01%-0.1%. The steel may further include at least one of Cr: 0.001%-0.05%, V: up to 0.005%, Mo: up to 0.015%, or N: 0.001%-0.004%, which may have the following (Continued)

mechanical properties: Rp0.2<180 MPa, Rm<340 MPa, A80<40%, and n value <0.23. At least one surface may have an arithmetic mean roughness Ra of 0.8-1.6 μm and a peak count RPc of 75/cm. The present disclosure also concerns methods for producing flat steel products.

18 Claims, 1 Drawing Sheet

(51) Int. Cl.

| | |
|---|---|
| ***C22C 38/06*** | (2006.01) |
| ***C22C 38/02*** | (2006.01) |
| ***C21D 9/46*** | (2006.01) |
| ***C22C 38/00*** | (2006.01) |
| ***C23C 2/02*** | (2006.01) |
| ***C22C 38/50*** | (2006.01) |
| ***C22C 38/44*** | (2006.01) |
| ***C22C 38/48*** | (2006.01) |
| ***C22C 38/54*** | (2006.01) |
| ***C22C 38/46*** | (2006.01) |
| ***C22C 38/42*** | (2006.01) |
| ***C22C 38/14*** | (2006.01) |

(52) U.S. Cl.
CPC ..... *C21D 9/46* (2013.01); *C22C 38/001* (2013.01); *C22C 38/004* (2013.01); *C22C 38/008* (2013.01); *C22C 38/02* (2013.01); *C22C 38/04* (2013.01); *C22C 38/06* (2013.01); *C22C 38/14* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C23C 2/02* (2013.01); *C21D 2211/005* (2013.01)

(58) Field of Classification Search
CPC ..... C22C 38/004; C22C 38/02; C22C 38/04; C22C 38/06; C22C 38/14; C22C 38/001; C22C 38/008; C22C 38/42; C22C 38/44; C22C 38/46; C22C 38/48; C22C 38/50; C22C 38/54; C23C 2/02
See application file for complete search history.

(56) References Cited

U.S. PATENT DOCUMENTS

| | | | | |
|---|---|---|---|---|
| 2003/0047257 | A1* | 3/2003 | Kami | C21D 8/0273 148/651 |
| 2004/0103962 | A1* | 6/2004 | Kami | C21D 8/0236 148/603 |
| 2004/0202889 | A1* | 10/2004 | Fujita | C23C 2/02 428/659 |
| 2009/0025838 | A1* | 1/2009 | Mineji | B21B 1/22 148/645 |
| 2011/0318217 | A1* | 12/2011 | Fujita | C21D 8/0236 420/8 |
| 2013/0206284 | A1 | 8/2013 | Norden | |
| 2013/0248060 | A1* | 9/2013 | Maruyama | C21D 9/46 148/645 |
| 2014/0034195 | A1 | 2/2014 | Suto | |

FOREIGN PATENT DOCUMENTS

| | | | |
|---|---|---|---|
| CN | 102985570 | A | 3/2013 |
| CN | 103597110 | A | 2/2014 |
| CN | 104946978 | A | 9/2015 |
| DE | 3686816 | T | 4/1993 |
| DE | 19622164 | C | 5/1997 |
| DE | 19701443 | A | 7/1998 |
| DE | 102004013031 | A | 10/2005 |
| DE | 102012017703 | A | 3/2014 |
| EP | 0234698 | B | 9/1987 |
| EP | 0484960 | A | 5/1992 |
| EP | 1111081 | A | 6/2001 |
| EP | 2006037 | B | 12/2008 |
| EP | 2508629 | A | 10/2012 |
| EP | 2700731 | A | 2/2014 |
| JP | 61291924 | A | 12/1986 |
| JP | 2267228 | A | 11/1990 |
| JP | 4200902 | A | 7/1992 |
| JP | 5279797 | A | 10/1993 |
| JP | 2001288549 | A | 10/2001 |
| JP | 20024019 | A | 1/2002 |
| JP | 2002363766 | A | 12/2002 |
| JP | 200380302 | A | 3/2003 |
| JP | 2003183801 | A | 7/2003 |
| JP | 2003306759 | A | 10/2003 |
| JP | 200476158 | A | 3/2004 |
| JP | 2005246432 | A | 9/2005 |
| JP | 201077480 | A | 4/2010 |
| JP | 2015527203 | A | 9/2015 |
| WO | 0233141 | A1 | 4/2002 |
| WO | 2011162135 | A | 12/2011 |
| WO | 2014037545 | A | 3/2014 |

OTHER PUBLICATIONS

English translation of International Search Report issued in PCT/EP2015/070577, dated Sep. 28, 2015 (dated Oct. 2, 2015).
Dipl.-Ing. Benedikt Ritterbach, Wolfenbüttel, "Qualitätsregelkreis zur Erzeugung definierter Feinblechrauheiten mit verschieden Texturierverfahren" published in 1999.
P. Louis et al. "Continuous Annealing Line of Sollac Ste Agathe", Developments in the annealing of sheet steels pp. 43-49, published in 1992.
Kohichi taya, et al. "Development of the strip temperature control technique for a continuous annealing line", Developments in the annealing of sheet steels, pp. 133-143, published in 1992.
Stahl-Eisen-Prüfblatt, "Waviness Characteristic Wsa (1-5)", Sep. 1941:May 2012.
Henning Meier, "Über die Aufrauhung von Walzenoberflächen mit Funkenentladungen" [The Roughening of Roll Surfaces by Spark Discharges], TU Braunschweig 1999, Shaker Verlag 1999.
Third Party Observation issued in PCT/EP2015/070577, dated Feb. 7, 2017.
English Abstract of DE102004013031.
English Abstract of EP2006037.

* cited by examiner

COLD-ROLLED AND RECRYSTALLIZATION ANNEALED FLAT STEEL PRODUCT, AND METHOD FOR THE PRODUCTION THEREOF

CROSS REFERENCE TO RELATED APPLICATIONS

This application is a U.S. National Stage Entry of International Patent Application Serial Number PCT/EP2015/070577, filed Sep. 9, 2015, which claims priority to European Patent Application No. EP 14188314.0 filed Oct. 9, 2014, the entire contents of which are incorporated herein by reference.

FIELD

The present disclosure generally relates to cold-rolled and recrystallization-annealed flat steel products having ferritic microstructures and methods for producing such flat steel products.

BACKGROUND

Flat steel products are especially used in the field of automobile chassis construction, where particularly high demands are made on the formability and visual appearance of the components formed from such flat steel products.

Where reference is made here to flat steel products, these are rolled products such as steel strips or sheets, and blanks and sheet bars obtained therefrom.

Flat steel products intended for chassis construction or comparable applications are typically provided with a surface structure which features a defined roughness and a likewise defined peak distribution, in order to satisfy customer-specific demands that exist with regard to formability and surface impression (paintability and paint gloss). A typical example of corresponding specifications from the automotive industry sector is an arithmetic mean roughness (called "roughness" for short hereinafter) Ra of 1.1-1.6 μm with a peak count RPc of at least 60 l/cm. Roughness Ra and peak count RPc are determined according to Stahleisenprüfblatt [Steel and Iron Test Specification] SEP 1940 by means of a stylus instrument according to ISO 3274.

A further criterion for determination of the surface characteristics to be achieved for optimal paintability and optimal paint gloss is called the "waviness characteristic Wsa (1-5)", called "Wsa" for short hereinafter, which is determined according to Stahl-Eisen-Prüfblatt SEP 1941: 2012-05 after 5% plastic elongation by the Marciniak cup test. Typical requirements for Wsa values are from 0.35 μm to 0.40 μm. Particularly good paint gloss is established at Wsa values of ≤0.35 μm, especially <0.30 μm. In order to achieve such low Wsa values, peak counts RPc of at least 75 l/cm and roughnesses Ra of 0.9-1.4 μm are required.

In the production of cold-rolled flat steel products, the material characteristics Ra and RPc are typically established by temper rolling after the recrystallization annealing, through which the flat steel products pass after the cold rolling in order to assure optimal formability thereof.

"Temper rolling" is understood here to mean partial rolling or further rolling performed after the recrystallization annealing, in which the flat steel product is subjected to a low deformation of about 0.2%-2.0%, which is referred to here as "temper reduction". The temper reduction is determined here by a comparison of the peripheral speeds of the deflecting rollers that are provided with position-determining devices, upstream and downstream of the roll stand in which the flat steel product is temper-rolled. The temper reduction D arises from the difference in distance traveled by the deflecting rollers (distance traveled at inlet s1, distance traveled at outlet s2), calculated as D=[(s2−s1)/s1]*100.

The combined requirement for "high peak count RPc" and "high roughness Ra" is fundamentally a complex manufacturing task. This is because a high roll roughness required for achievement of high Ra values fundamentally entails a low peak count RPc, since the increasing surface fissuring (=roughness) of the roll increases the distance from wave crest to wave crest on the roll surface and hence reduces the number of peaks that can be formed on the flat steel product. A further complicating factor is that, even in the case of dry temper rolling, a peak transfer loss of about 20% is recorded in the transfer of the peaks present on the roll surface to the flat steel product being rolled in the particular case.

An additional factor is the rule that, if the temper reduction D chosen is too high, the roughness Ra will be too high. If, by contrast, the temper reduction D is set too low, there could be untempered strip edges, especially in the case of broad strip dimensions. At those points, the Ra and RPc values are then too low.

The temper reduction D also cannot be varied as desired with regard to the mechanical properties of the steel substrate. Too low a temper reduction D only inadequately counteracts a marked yield strength. Too high a temper reduction D, by contrast, can cause the strength of the steel substrate to be too high in a non-correctable manner because of excessively intense cold solidification.

The softer, broader and thinner the flat steel product to be produced is, the greater the demands on the temper rolling. A "soft" steel is understood here to mean a steel which, in the recrystallized state and after the temper rolling, has a yield strength Rp0.2 of not more than 180 N/mm$^2$ and a tensile strength Rm of not more than 340 N/mm$^2$. The result of this in practice is that flat steel products of the type in question with automobile-typical dimensions can currently only be produced with the desired operational reliability with a great deal of complexity. Particularly critical steels are those having a yield strength Rp0.2 of max. 150 MPa and a tensile strength Rm of not more than 310 MPa.

There are various known proposals for making this degree of complexity controllable in practice, and for producing flat steel products which are to provide optimal prerequisites for painting with a gloss that meets even the strictest requirements.

One example of this is the method, known from EP 0 234 698 B1, of producing a steel sheet suitable for painting. This method envisages producing a regular pattern of depressions in the surface of a temper roll by means of a beam of energy. The flat steel product to be processed is temper-rolled by means of two working rolls, at least one of which has been processed in the manner specified above. The reduction in cross section achieved via the temper rolling is to be not less than 0.3%, in order to transfer the pattern from the working roll to the surface of the steel sheet. In this way, a steel sheet having an average surface roughness Ra within the range from 0.3 to 3.0 μm and a microscopic form that forms the surface roughness, consisting of trapezoidal elevation regions with a planar upper surface, groove-like depression regions formed in such a way that they completely or partly surround an elevation region, and planar middle regions formed between the elevation regions outside the depression regions such that they are higher than the base of the depression regions and lower than or of the same height as the upper surfaces of the elevation regions, is to be obtained.

At the same time, the elevations and depressions are to have particular geometric dependences on parameters including the diameter of the depressions formed into the working temper roll.

A comparable proposal has been made in DE 36 86 816 T2. This too has proposed introducing a homogeneous surface roughness pattern into the surface of a cold-rolled flat steel product, which leads to a surface roughness Ra of 0.3-2.0 μm.

Finally, WO 2011/162135 A1 discloses a thin cold-rolled steel sheet and a method of production thereof. This steel sheet consists of a steel having, in % by weight, 0.10% or less of C, 0.05% or less of Si, 0.1%-1.0% Mn, 0.05% or less of P, 0.02% or less of S, 0.02%-0.10% Al and less than 0.005% N, the remainder consisting of Fe and unavoidable impurities. The steel sheet having these characteristics is subjected to an annealing treatment in which it is annealed at an annealing temperature of 730-850° C. for at least 30 s and then cooled to a temperature of not more than 600° C. at a cooling rate of at least 5° C./s. The annealed cold-rolled flat steel product obtained thereafter has a microstructure consisting mainly of ferrite, having an average crystal grain diameter of 5-30 μm. Finally, the flat steel product is temper-rolled using a roll having a surface roughness Ra of not more than 2 μm. The stretching ratio achieved via the temper rolling is set as a function of the average crystal grain diameter of the thin cold-rolled annealed sheet.

DETAILED DESCRIPTION

Figure 1:
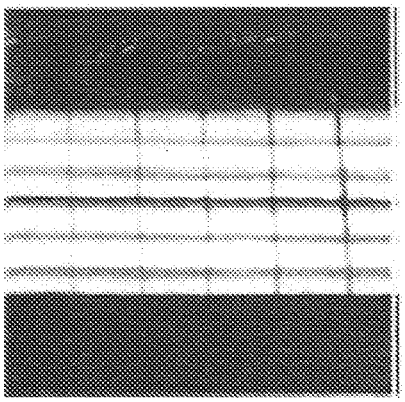
FIG. 1 is a sectional view of a painted surface of an automobile chassis component formed from a flat steel product of the present disclosure.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

Where figures are given in relation to contents of alloys, these always relate to the weight, unless stated otherwise. By contrast, figures relating to the composition of atmospheres always relate to the volume in question, unless stated otherwise.

Against the background of the prior art elucidated above, it was an object of the invention to specify a flat steel product having optimized formability and excellent painting properties, which can be produced in an economically viable and operationally reliable manner.

A method of producing a flat steel product of the invention was likewise to be specified.

A cold-rolled and recrystallization-annealed flat steel product of the invention, having a ferritic microstructure, accordingly consists of a steel having the following composition (in % by weight):

C: 0.0001%-0.003%,
Si: 0.001%-0.025%,
Mn: 0.05%-0.20%,
P: 0.001%-0.015%,
Al: 0.02%-0.055%,
Ti: 0.01%-0.1%,
the remainder being iron and unavoidable impurities, where the steel may additionally contain the following optional alloy elements:
Cr: 0.001%-0.05%,
V: up to 0.005%,
Mo: up to 0.015%,
N: 0.001%-0.004% and has a yield strength Rp0.2 of up to 180 MPa,
a tensile strength Rm of up to 340 MPa,
an elongation at break A80 of at least 40%,
an n value of at least 0.23
and, on at least one of its surfaces,
an arithmetic mean roughness Ra of 0.8-1.6 μm
and
a peak count RPc of at least 75 1/cm.

In this case, the depressions and peaks shaped into the surface that account for the mean roughness Ra and the peak count RPc are in stochastic distribution.

A flat steel product of the invention thus consists of a soft steel having a yield strength Rp0.2 of up to 180 MPa, especially of less than 150 MPa, and a tensile strength Rm of up to 340 MPa, especially of less than 310 MPa, and at the same time has an elongation at break A80 of at least 40%, high elongation and a high n value of at least 0.23. With this combination of properties, it is optimally suited to forming, especially to deep drawing.

At the same time, a flat steel product of the invention has surface characteristics characterized by an arithmetic mean roughness Ra of 0.8-1.6 μm and a peak count RPc of at least 75 1/cm, which imparts excellent suitability thereto for painting with optimized paint gloss. Thus, surface structures of the invention reliably achieve Wsa values of not more than 0.40 μm, typically not more than 0.35 μm, especially less than 0.30 μm, more particularly also when the flat steel products of the invention are within a spectrum of dimensions typical of automobile applications with thicknesses of up to 1.0 mm and widths of at least 1000 mm.

A flat steel product of the invention has its particular suitability for forming and painting in the uncoated state or in a state coated with a metallic protective layer.

If such a metallic coating is provided, it should be applied by electrolytic coating. By employing known electrolytic methods, it is ensured that the surface structure of the steel strip temper-rolled in accordance with the invention is preserved at the surface of the flat steel product coated with the metallic coating. A suitable metallic protective layer is especially an electrolytically applied layer based on zinc.

As an alternative or in addition to a metallic protective coating of the aforementioned type, the flat steel product of the invention can also be coated with an inorganic or organic coating. An inorganic coating means a passive layer typical of strip processes, for example in the form of a phosphation or chromation. An organic coating means a thick film passivation typical of strip processes, for example based on Cr(III)-containing compounds. It is possible here to employ coating compositions that are likewise known per se and are typically used to improve paint adhesion, friction characteristics in the forming mold and the like.

The surface texture formed on the surface, having the characteristics of the invention, of a flat steel product of the invention is characterized by a stochastic distribution of the depressions and peaks which determine the inventive roughness value Ra and the inventive peak count RPc.

Stochastic surface textures as stipulated in accordance with the invention are irregular surface textures characterized by an irregular statistical distribution of the configuration features, for example depressions, which can in turn vary with respect to one another in terms of separation, shape and size. Deterministic surface textures, by contrast, are regular surface textures characterized by a regular distribution of configuration features of the same type.

Stochastic surface texturing is the aim in accordance with the invention in order to optimize friction characteristics between the steel surface and tool during forming processes in the oiled or greased state. In a tool-bound forming process, especially in the case of deep drawing or stretch drawing, it is a feature of a stochastic surface structure that, under high compressive stresses, the lubricant can flow away from the stress zone through microchannels which open up between the peaks and troughs of the surface texture. Compared to the more highly isolated lubrication pockets of a deterministic surface texture, this finer mesh of microchannels permits more homogeneous distribution of the lubricant over the entire surface area where there is contact between tool and flat steel product in the forming process. In addition, a stochastic base structure assures leveling and adhesion properties for organic or metallic coatings which, if required, can additionally be applied to the flat steel product of the invention.

The roughness value Ra in the case of the inventive surface of an inventive flat steel product should be not less than 0.8 μm, since the surface is otherwise too smooth. However, the roughness value Ra should not be greater than 1.6 μm either, because the surface is then too rough to achieve optimized forming properties. In order to be able to utilize the advantages of the invention in an operationally reliable manner, roughness values Ra of 0.9-1.4 μm may be provided.

The peak count RPc should not be less than 75 per cm, because this will have an adverse effect on the Wsa value. By fixing the peak count at at least 75 1/cm, it is ensured that the Wsa value of a flat steel product of the invention does not rise above 0.40 μm, especially not above 0.35 μm, and a paint system achieves optimal paint gloss. Higher peak counts lead to further-improved Wsa values of the surface, having the characteristics of the invention, of a flat steel product of the invention. In this way, the Wsa values of flat steel products of the invention of less than 0.30 μm can be achieved. Wsa values of not more than 0.40 μm are achieved in an operationally reliable manner when the peak count RPc for the surface having the characteristics of the invention is fixed at at least 75 per cm. Wsa values of not more than 0.35 μm are established when the peak count RPc for the flat steel product surface having the characteristics of the invention is fixed at at least 80 per cm. Wsa values of less than 0.30 μm can finally be assured in that a minimum value of 90 per cm is fixed for the peak count RPc.

A flat steel product of the invention comprises, as obligatory alloy elements, C, Si, Mn, P, Al and Ti with the following proviso:

The C content of the flat steel product of the invention is 0.0001%-0.003% by weight. C is unavoidably present in the steel melt, and so C contents of at least 0.0001% by weight are always detectable in a steel of the invention. However, a C content above 0.003% by weight worsens the desired forming capacity as a result of an excessively high strength contribution of the carbon. This can be reliably prevented by lowering the C content to 0.002% by weight or less.

Si is present in a flat steel product of the invention in contents of 0.001%-0.025% by weight. Si is also unavoidably present in the steel melt. However, an Si content above the limit of the invention of 0.025% by weight worsens the forming capacity as a result of an excessively high strength contribution. In order to avoid adverse effects of the presence of Si, the Si content of a flat steel product of the invention can be restricted to not more than 0.015% by weight.

Mn is present in a flat steel product of the invention in contents of 0.05%-0.20% by weight. Mn contents within this range make an optimal contribution to the forming capacity of a flat steel product of the invention. In the case of Mn contents outside the range specified in accordance with the invention, there is an excessively low or excessively high contribution resulting from solid solution hardening. An optimal influence of the presence of Mn in the flat steel product of the invention can be assured by restricting the Mn content to not more than 0.15% by weight.

P is present in the flat steel product of the invention in contents of 0.001%-0.015% by weight. P is also unavoidably present in the steel melt and makes a contribution to solid solution hardening. However, a P content above the limit of the invention worsens the desired forming capacity and shows adverse effects on the desired painting result. In order to utilize the positive effects of the presence of P resulting from solid solution hardening and at the same time to reliably rule out adverse effects, the P content can be restricted to not more than 0.012% by weight.

Al is present in a flat steel product of the invention in contents of 0.02%-0.055% by weight. Al in steel production serves to deoxidize the steel melt and therefore has to be included in the alloy within the limits of the invention. However, an Al content above the upper limit in the Al content envisaged in accordance with the invention worsens the desired forming capacity. It is possible to utilize the positive effect of Al in the alloy of a flat steel product of the invention in an optimal manner by restricting the Al content to not more than 0.03% by weight.

Ti is present in a flat steel product of the invention in contents of 0.01%-0.1% by weight. Ti serves to bind interstitial alloy elements and thus contributes to precipitation hardening. In the case of a Ti content of less than 0.01% by weight, interstitial alloy elements are still in dissolved form in the crystal lattice, which has an adverse effect on the desired forming capacity. Ti contents above 0.1% by weight do not additionally improve the forming capacity. The positive effects of the presence of Ti can be utilized with high reliability when the Ti content is 0.05%-0.09% by weight.

As well as the aforementioned alloy elements that are always present in a flat steel product of the invention, a flat steel product of the invention may optionally additionally contain the following alloy elements in order to achieve or establish particular properties:

Cr may be added to a flat steel product of the invention in contents of 0.001%-0.05% by weight, such that the presence of Cr in the case of such low contents has a positive effect on the mechanical properties of the flat steel product of the invention, especially the yield strength and tensile strength thereof. However, a Cr content above the range envisaged in accordance with the invention worsens the desired forming capacity.

In the same way, V may optionally be included in the alloy of the steel melt in order likewise to contribute to the binding of interstitial alloy elements and hence to precipitation hardening. For this purpose, V may be present in the flat steel product of the invention in contents of up to 0.005% by weight.

Mo may optionally be present in the flat steel product of the invention in contents of up to 0.015% by weight, in order to serve for solid solution hardening. However, an Mo content above the limit of the invention worsens the desired forming capacity.

In principle, contents of N in the flat steel product of the invention can be counted among the technically unavoidable impurities. In contents of 0.001%-0.004% by weight, however, N can additionally serve for precipitation hardening through formation of TiN. If the proportion of N is greater than 0.004% by weight, there is the risk that nitrogen will be in dissolved form in the crystal lattice and cause a marked yield point which causes poor deep drawability. Therefore, the N content optionally present is optimally limited to not more than 0.003% by weight, in order to assure the desired forming properties.

As well as the aforementioned alloy elements and iron as the main constituent of a steel of the invention, technically unavoidable impurities may be present in the flat steel product of the invention. These include B, Cu, Nb, Ni, Sb, Sn and S, the proportion of which should add up to not more than 0.2% by weight, and in the case of the presence of Nb, B or Sb the following specific provisos apply to these impurities: Sb content not more than 0.001% by weight, Nb content not more than 0.002% by weight and B content not more than 0.0005% by weight.

Flat steel products having the characteristics of the invention can be produced, for example, by the inventive manner of production.

For this purpose, the method of the invention for producing a flat steel product of the invention comprises the following operating steps:

a) providing a roll-hardened, cold-rolled flat steel product having ferritic microstructure, consisting, in accordance with the above elucidations, of a steel having the following composition (in % by weight):
   C: 0.0001%-0.003%,
   Si: 0.001%-0.025%,
   Mn: 0.05%-0.20%,
   P: 0.001%-0.015%,
   Al: 0.02%-0.055%,
   Ti: 0.01%-0.1%,
   the remainder being iron and unavoidable impurities,
   where the steel may additionally contain the following optional alloy elements:
   Cr: 0.001%-0.05%,
   V: up to 0.005%,
   Mo: up to 0.015%,
   N: 0.001%-0.004%;

b) heat treating the flat steel product in a continuous run through an annealing furnace under an annealing atmosphere which, at a dew point of −10° C. to −60° C., consists of 1%-7% by volume of $H_2$, the remainder being $N_2$ and unavoidable impurities,
   wherein the flat steel product, for recrystallization annealing,
   is heated up to a hold temperature T1 of 750-860° C.,
   is kept at the hold temperature T1 for a period t1 of 30-90 s,
   wherein the flat steel product, for a subsequent overaging treatment,
   is cooled from the hold temperature T1 at a cooling rate CR1 of 2-100° C./s to an overaging start temperature T2 of 400-600° C.,
   after cooling to the overaging start temperature T2, is cooled over a period t2 of 30-400 s at a cooling rate CR2 of 0.5-12° C./s to an overaging end temperature T3 of 250-350° C., and
   wherein the flat steel product, after cooling to the overaging end temperature T3, is cooled at a cooling rate CR3 of 1.5-5.0° C./s to room temperature;

c) temper rolling the recrystallization-annealed flat steel product with a temper reduction D of 0.4-0.7% using a working temper roll having a circumferential area that comes into contact with the flat steel product having an arithmetic mean roughness Ra of 1.0-2.5 μm and a peak count RPc of at least 100 1/cm, wherein the depressions and peaks shaped into the surface of the working temper roll that account for the mean roughness Ra and the peak count RPc are in stochastic distribution.

In operating step b) of the method of the invention, the respective component steps envisaged for the heat treatment of the flat steel product are performed in a continuous furnace. The heat treatment process is effected in the form of an annealing operation performed in a continuous run, because the individual component steps of the heat treatment can follow on homogeneously from one another in this way. The uninterrupted sequence results in distinctly lower scatter in the mechanical properties of the flat steel product over the length and width thereof.

In the heat treatment which proceeds continuously in the continuous furnace envisaged in practice, individual sections, in a manner known per se, can be heated directly in the manner of a DFF (direct fired furnace), a DFI (direct flame impingement) furnace or an NOF (nonoxidizing furnace), or indirectly, for example in the manner of an RTF (radiant tube furnace).

The cooling of the flat steel product to the overaging start temperature T2 and the final cooling of the flat steel product to room temperature can be conducted in a conventional manner by injection of gas, e.g. $N_2$, $H_2$ or a mixture thereof, by application of water or mist, or by cooling via contact with chill rolls, and each of these measures can also be conducted in combination with one or more of the other cooling measures.

For recrystallization annealing, a hold temperature T1 within the temperature range of 750–860° C. is envisaged. In the case of annealing temperatures below 750° C., complete recrystallization of the microstructure of the flat steel product can no longer be reliably achieved. At temperatures of more than 860° C., by contrast, there is the risk of coarse grain formation. Both would have an adverse effect on the forming properties. Optimal results for the recrystallization annealing are obtained when the temperature T1 is 800-850° C.

The period t1 over which the flat steel product is kept at the hold temperature T1 in the recrystallization annealing is 30-90 seconds, in order to assure optimal forming properties of the flat steel product produced in accordance with the invention. If t1 were to be less than 30 seconds, complete recrystallization of the microstructure could no longer be achieved in an operationally reliable manner. In the case of a hold time t1 longer than 90 seconds, there would again be the risk of coarse grain formation.

After being kept at the hold temperature T1, the flat steel product is cooled at a cooling rate CR1 of 2-100° C./s to the overaging start temperature T2. The cooling rate CR1 is chosen so as to obtain a flat steel product having optimal forming properties. A minimum cooling rate CR1 of 2° C./s is required to avoid coarse grain formation. If, in contrast, the cooling rate CR1 is above 100° C./s, excessively fine grains would form, which would likewise be detrimental to the desired good formability.

The overaging start temperature T2 is at least 400° C. because, in the case of lower temperatures the cooling power required for the cooling to the overaging start temperature T2 is high, but there would no longer be any additional positive effect on the material properties. If the overaging start temperature T2, by contrast, were above 600° C., the recrystallization would not be stopped in a sufficiently sustainable manner, and there would be the risk of coarse grain formation. With an overaging start temperature T2 of 400-600° C., especially 400-550° C., it is possible to achieve optimized forming properties.

Proceeding from the overaging start temperature, the flat steel product, over a period t2 of 30-400 seconds, is subjected to an overaging treatment in which it is cooled at a cooling rate CR2 of 0.5-12° C./s to the overaging end temperature T3. If the period t2 were to be less than 30 seconds, the period in which the interstitial alloy atoms could be homogeneously distributed by diffusion in the recrystallized microstructure of the flat steel product would be too short. This would have an adverse effect on the forming properties. An overaging treatment lasting longer than 400 seconds would not achieve any additional positive effect. A cooling rate CR2 of at least 0.5° C./s is established in order to conclude the overaging treatment within a practicable period. If, in contrast, a cooling rate CR2 above 12° C./s were to be established, the period t2 of overaging treatment would be too short. In that case, too little time would be available for the diffusion of the interstitial alloy elements, as a result of which the forming properties would be worsened in turn.

According to the invention, the end temperature T3 of the overaging treatment is 250-350° C. If the overaging end temperature T3 were above 350° C., the flat steel product would be too hot when passed on into the final cooling, which would have an adverse effect on the surface quality and hence the painting properties of the flat steel product of the invention. An overaging end temperature T3 below 250° C., by contrast, would not have any additional positive effect.

The component operating steps of operating step b) are conducted under a protective gas annealing atmosphere having a hydrogen content of 1%-7% by volume and otherwise consisting of nitrogen and technically unavoidable impurities. In the case of an $H_2$ content of less than 1.0% by volume, there would be the risk of oxide formation on the surface of the flat steel product, which would result in worsening of the surface quality and hence the painting properties thereof. An $H_2$ content of the annealing atmosphere above 7.0% by volume, by contrast, would not bring any additional positive effect and would also be problematic from the aspect of operational safety.

According to the invention, the dew point of the annealing atmosphere is −10° C. to −60° C. If the dew point of the annealing atmosphere were above −10° C., there would likewise be the risk of oxide formation, which is unwanted in terms of the desired surfaces, on the surface of the flat steel product. A dew point below −60° C. would be achievable on the industrial scale only at great cost and inconvenience, and would also not have any additional positive effect. Optimal operating conditions arise when the dew point of the annealing atmosphere is −15° C. to −50° C.

The cooling of the flat steel product which sets in after the end of the overaging treatment proceeds under the protective gas atmosphere already elucidated. In this case, a cooling rate CR3 of 1.5-5.0° C./s is envisaged. This cooling rate CR3 is chosen such that deterioration in the surface characteristics through oxide formation, which could occur in the case of excessively slow cooling, is avoided in an economically viable manner.

Operating step c) of the method of the invention is essential for the particularly good suitability of flat steel products of the invention for painting with optimized paint gloss. This particular suitability arises from a Wsa value of not more than 0.40 μm, typically not more than 0.35 μm, especially less than 0.30 μm, which represents minimized waviness of the flat steel product surface.

The above-defined temper reduction D in the temper rolling (operating step c)) envisaged in accordance with the invention after the heat treatment (operating steps b)) is 0.4%-0.7%. In the case of a temper reduction D of less than 0.4%, inadequate deformation of the flat steel product for optimal forming properties would be achieved. Nor would it be possible to achieve the values specified in accordance with the invention for the roughness Ra and the peak count RPc with such low temper reductions. In the case of a temper reduction D of more than 0.7%, however, there would be the risk of excessive hardening being introduced into the steel strip, which would in turn have an adverse effect on the forming properties. Furthermore, temper reductions D of more than 0.7% would lead to a roughness Ra outside the range of roughnesses specified in accordance with the invention with regard to the desired surface properties. In order to produce the surface structure specified in accordance with the invention with high operational reliability in the case of particularly broad flat steel products, i.e. flat steel products having a width of typically 1500 mm or more, the temper reduction D can be set to at least 0.5%. If every adverse effect of temper rolling is to be avoided, the temper rolling D can be limited to a maximum of 0.6% for this purpose. The latter is an option especially when the alloy constituents of the steel of which a flat steel product of the invention consists of each present with contents within the ranges emphasized as being particularly advantageous above.

In order that the temper rolling impresses a surface structure that meets the requirements of the invention that have been optimized with regard to the painting properties into the surface of the flat steel product, the working temper roll that acts on the surface of the flat steel product in question has a roughness Ra of 1.0-2.5 μm and a peak count RPc of at least 100 per cm. If the roughness Ra of the working roll were to be less than 1.0 μm or greater than 2.5 μm, the inventive values of Ra and RPc cannot be applied within the limits of the invention in the flat steel product. Forming and painting properties would correspondingly deteriorate. In order to ensure in practice that the roughness values Ra required in accordance with the invention are achieved in an operationally reliable manner in the flat steel product, the roughness Ra of the working temper roll can be set to 1.2-2.3 μm.

The peak count RPc of the working temper roll surface is at least 100 per cm, although higher peak counts RPc, such as peak counts RPc of the working roll of at least 110 per cm, especially more than 130 per cm, are particularly advantageous. By virtue of high peak counts RPc of 100 per cm or more coming into contact with the peripheral surface of the working temper roll that comes into contact with the flat steel product, it is ensured that the required peak count RPc is transferred to the likewise temper-rolled flat steel product with application of the above-elucidated temper rolling parameters that meet the requirements of the invention.

In order that a surface structure having stochastic distribution of the peaks and troughs forms on the particular surface of the flat steel product, the surface structure of the peripheral surface of the working temper roll that comes into contact with the flat steel product is correspondingly stochastic.

The surface structure envisaged in accordance with the invention can be produced, for example, in a manner known per se by means of the EDT ("EDT"=Electro Discharge Texturing) technique established for the controlled roughening of temper rolls in the cap (−) or pulse (+) method. A detailed elucidation of these methods can be found in the thesis by Henning Meier, "Über die Aufrauhung von Walzenoberflächen mit Funkenentladungen" [The Roughening of Roll Surfaces by Spark Discharges], TU Braunschweig 1999, Shaker Verlag 1999.

The EDT technique is based on roughening of the roll surface by spark erosion. For this purpose, the working temper roll is moved past an electrode in a tank with a dielectric therein. As a result of sparkover, small craters are made in the roll surface. When the electrode is connected as the anode (+) (i.e. the current flows away from the roll to the electrode), very inhomogeneous craters are formed on the roll, which is associated with a relatively high peak count. In the reverse case (i.e. connection of the electrode as the cathode (−)), the current flows towards the roll. The result is smooth craters.

The cap (−) variant of the EDT technique is based on a capacitor discharge that occurs as soon as the electrode is close enough to the roll. The cap method produces a stochastic texture on the working rolls, since the capacitance varies to different degrees (between 30% and 100%), and hence holes of different size are made in the roll material.

The pulse (+) variant of the EDT technique is based on a principle where the amount of energy which is applied to the roll to be textured is always the same. This results in formation of a stochastic surface texture with greater regularity, but one which offers stochastic distribution of the depressions and peaks which is sufficient for the purposes of the invention.

Following the roughening, the working roll of the invention can optionally undergo an aftertreatment. In this aftertreatment, significantly projecting peaks of the surface structure are ground off, in order to reduce contamination of the flat steel product surface by peaks that have broken off. The aftertreatment can be conducted in the form of a superfinish treatment. This is an ultrafine processing method with the aim of removing tips that protrude beyond the mean roughness depth, or reducing the number thereof to a minimum. Means of practical implementation of the superfinish method are known, for example, from DE 10 2004 013 031 A1 or EP 2 006 037 B1. The peak count changes to a negligibly small extent as a result of the particular aftertreatment. However, the surface is homogenized and the percentage contact area is increased. This is reflected in a negative Rsk value (=skewness of the roughness distribution). In the case of high Rsk values, the roughness accordingly has an inhomogeneous distribution, whereas low or negative Rsk values are associated with a very homogeneous roughness distribution.

The working temper rolls can finally be hard chrome-plated in a known manner prior to their use, in order to optimize their wear resistance.

It is advantageous from an operational point of view to perform operating steps b) and c) of the method of the invention in an uninterrupted manner in a continuous run. For this purpose, the heat treatment unit (operating step b)) and the temper rolling stand required for operating step c) are set up in one line. The temper rolling in operating step c) of the flat steel product which has been cooled after operating step b) and emerges from the heat treatment unit is then executed in a single temper pass. If the temper rolling, by contrast, is to be executed off-line, i.e. independently of the heat treatment sequence, it is also possible for two or more temper roll passes to be executed, although it is found here too that optimal results are achieved when the off-line temper rolling is performed in just one pass.

The optimal use of a temper medium (wet tempering) can have advantages with regard to a cleaning or lubrication effect in the temper rolling. Dry tempering, by contrast, can have the advantage that the flat steel product does not come into contact with any wetting medium and, as a result, the risk of formation of corrosion in any subsequent storage or further processing of the flat steel product is also minimized.

Through application of the method of the invention, it is possible to produce a flat steel product having the above-mentioned mechanical material properties of the invention, which simultaneously has the surface structure of the invention across the complete strip width (complete temper rolling). The surface texturing of the invention, which is characterized by roughness values Ra and peak values RPc corresponding to the requirements of the invention can generate much better paint gloss compared to a comparative product having noninventive surface texturing.

Cold-rolled, roll-hardened flat steel products have been provided in the form of steel strips B1-B12 from steels S1-S6, which had the composition reported in Table 1.

The flat steel products were heat-treated in various dimensions in a continuous heat treatment furnace of the RTF design, then cooled to room temperature and subsequently subjected to in-line temper rolling.

The heat treatment comprises a recrystallization annealing operation in which the steel strips B1-B12 have been heated to a hold temperature T1 of 835° C.±15° C. at which they have been kept over a hold period T1 of 60 s.

After the recrystallization annealing, the steel strips B1-B12 have been subjected to an overaging treatment. For this purpose, they have been cooled from the hold temperature T1 at a cooling rate CR1 of 8.5° C./s to an overaging start temperature T2 of 530±15° C.

Proceeding from this, the steel strips B1-B12 have then each been cooled over an overaging period t2 of 302 seconds to an overaging end temperature T3 of 280±15° C. The cooling rate CR2 with which the steel strips B1-B12 have been cooled from the overaging start temperature T2 to the overaging end temperature T3 was 0.82° C./s.

Over the entire heat treatment, the steel strips B1-B12 have been kept under an annealing atmosphere that consisted of 4% by volume of $H_2$, the remainder having consisted of $N_2$ and unavoidable impurities. The dew point thereof was set to −45° C.±2° C.

After the end of the overaging treatment and before exit from the continuous furnace, the steel strips B1-B12 have been cooled under the protective gas atmosphere at a cooling rate CR3 of 3.5° C./s to room temperature and, in a continuation of the continuous run, guided into a quarto rolling stand having support rolls and working temper rolls which has been provided for the temper rolling. The working temper rolls of the temper rolling stand were always roughened in cap (−) mode by means of EDT technology and subjected to hard chrome-plating in a manner known per se. All temper rolling experiments were conducted without the use of a temper rolling medium (dry temper rolling).

The parameters of the temper rolling (temper reduction D, roughness Ra_W and peak count RPc_W of the peripheral surface of the working temper rolls that come into contact with the steel strips in each case), and also the width b, thickness d, yield strength Rp0.2, tensile strength Rm, elongation A80 and the n value determined for the steel strips B1-B12, are reported in table 2. The mechanical properties were determined in a quasi-static tensile test according to DIN 6892 with the sample positioned longitudinally with respect to rolling direction.

Likewise listed in table 2 are the roughness Ra and peak count RPc determined for the surfaces of the steel strips B1-B12. The arithmetic mean roughnesses Ra, Ra_W and peak count RPc, RPc_W were always measured according to Stahl-Eisen-Prüfblatt (SEP) 1940 by means of an electrical stylus instrument according to ISO 3274.

The properties of the steel strips B1 and B9 show that better Wsa values are achieved by means of higher peak counts RPc.

The noninventive steel strips B11 and B12 demonstrate the importance of the temper reduction for the success of the invention.

In addition, the Wsa values are determined for the surfaces of the steel strips B1-B12. The results are likewise recorded in table 2. They confirmed that the inventive working examples achieve a Wsa value of <0.40 μm and hence give optimal prerequisites for particularly good paint gloss. The waviness characteristic Wsa was measured according to Stahl-Eisen-Prüfblatt (SEP) 1941; measurement was made on a steel sample which, in the Marciniak cup test, underwent 5% plastic elongation.

Figure 2:
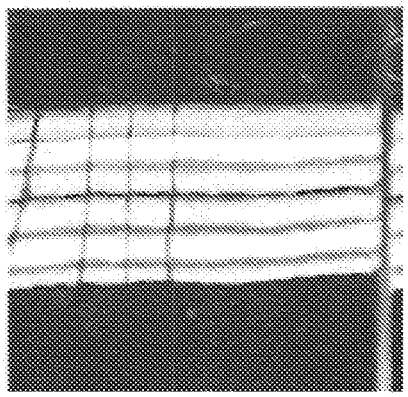
FIG. 2 is a sectional view of a painted surface of an automobile chassis component formed from a noninventive flat steel product.
Figure 3:
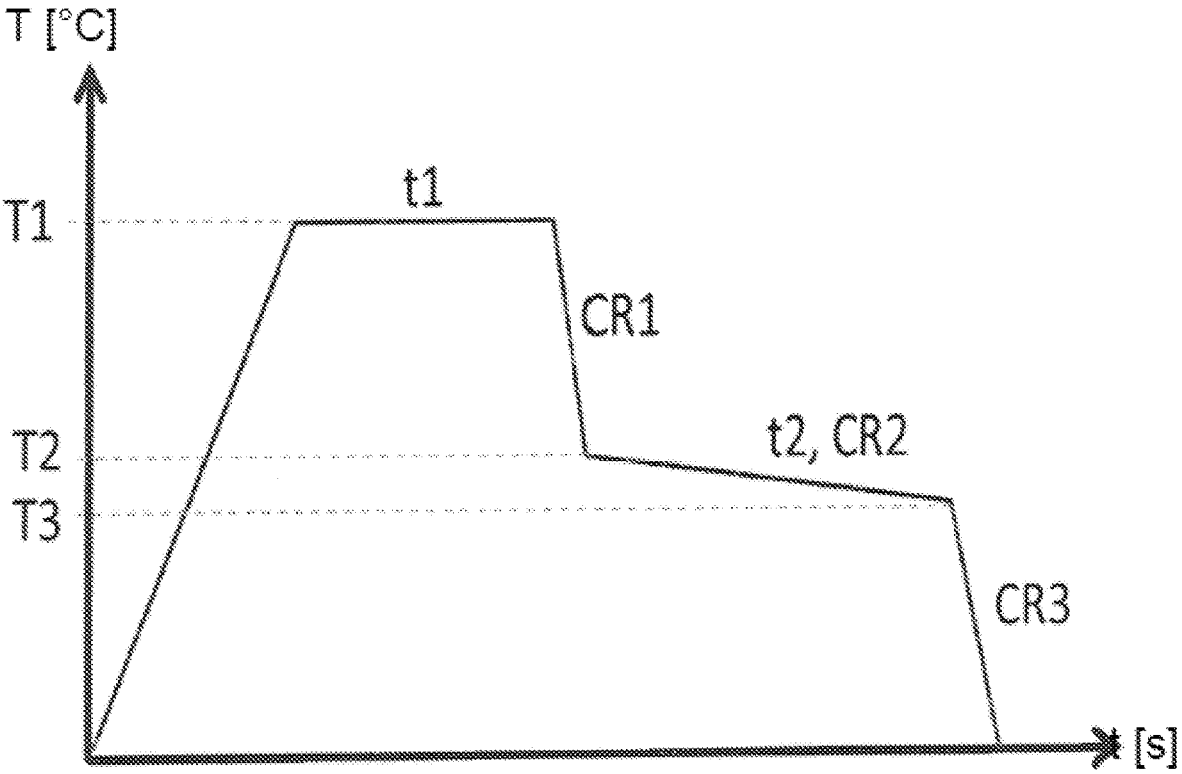
FIG. 3 a schematic profile of a heat treatment of the present disclosure (operating step b).

FIG. 1 and FIG. 2 illustrate this using a comparison of components which have been produced from an inventive and a noninventive flat steel product by forming and painting. The noninventive working example shown in FIG. 2 which has been produced from the steel strip B3 that does not fulfill the requirements of the invention, after painting, shows much poorer paint gloss than the example shown in FIG. 1, which has been formed from the inventive steel strip B1.

TABLE 1

| Steel | C | Si | Mn | P | Al | Ti | S | Cr | Nb | V | Mo | N | Cu | Ni | B | Sn |
|---|---|---|---|---|---|---|---|---|---|---|---|---|---|---|---|---|
| S1 | 0.0019 | 0.005 | 0.11 | 0.010 | 0.029 | 0.072 | 0.007 | 0.032 | 0.001 | 0.001 | 0.004 | 0.0017 | 0.014 | 0.021 | 0.0002 | 0.004 |
| S2 | 0.0015 | 0.006 | 0.13 | 0.010 | 0.026 | 0.069 | 0.009 | 0.045 | 0.001 | 0.001 | 0.006 | 0.0026 | 0.017 | 0.022 | 0.0002 | 0.007 |
| S3 | 0.0023 | 0.005 | 0.09 | 0.008 | 0.024 | 0.075 | 0.005 | 0.030 | 0.001 | 0.001 | 0.009 | 0.0027 | 0.017 | 0.027 | 0.0002 | 0.004 |
| S4 | 0.0025 | 0.006 | 0.09 | 0.008 | 0.024 | 0.073 | 0.007 | 0.024 | 0.001 | 0.002 | 0.004 | 0.0037 | 0.010 | 0.016 | 0.0002 | 0.005 |
| S5 | 0.0020 | 0.005 | 0.11 | 0.010 | 0.026 | 0.072 | 0.007 | 0.028 | 0.001 | 0.003 | 0.003 | 0.0025 | 0.011 | 0.015 | 0.0002 | 0.006 |
| S6 | 0.0016 | 0.007 | 0.11 | 0.006 | 0.029 | 0.073 | 0.006 | — | — | — | — | 0.0020 | 0.011 | 0.017 | 0.0002 | 0.004 |

Figures in % by weight, the remainder being iron and unavoidable impurities

TABLE 2

| Steel strip | Steel | d (mm) | b (mm) | Rp0.2 (MPa) | Rm (MPa) | A80 (%) | n | Ra (μm) | RPc (1/cm) | D (%) | Ra_W (μm) | RPc_W (1/cm) | Wsa [μm] | Inventive? |
|---|---|---|---|---|---|---|---|---|---|---|---|---|---|---|
| B1 | S1 | 0.85 | 1608 | 136 | 289 | 47.6 | 0.245 | 0.94 | 92 | 0.4 | 1.4 | 139 | 0.27 | yes |
| B2 | S1 | 0.85 | 1608 | 139 | 285 | 46.5 | 0.245 | 1.30 | 79 | 0.5 | 1.4 | 105 | 0.37 | yes |
| B3 | S2 | 0.74 | 1651 | 142 | 287 | 47.8 | 0.240 | 1.31 | 68 | 0.5 | 3.0 | 95 | 0.44 | no |
| B4 | S3 | 0.85 | 1573 | 142 | 294 | 47.5 | 0.241 | 1.35 | 84 | 0.6 | 2.2 | 115 | 0.33 | yes |
| B5 | S3 | 0.85 | 1573 | 138 | 290 | 47.2 | 0.247 | 1.29 | 83 | 0.5 | 2.2 | 115 | 0.32 | yes |
| B6 | S4 | 0.69 | 1551 | 147 | 302 | 44.0 | 0.238 | 1.16 | 85 | 0.6 | 2.2 | 114 | 0.34 | yes |
| B7 | S4 | 0.69 | 1551 | 146 | 303 | 45.4 | 0.236 | 1.18 | 80 | 0.6 | 2.2 | 110 | 0.35 | yes |
| B8 | S5 | 0.82 | 1610 | 160 | 297 | 45.8 | 0.230 | 1.27 | 53 | 0.7 | 1.5 | 90 | 0.47 | no |
| B9 | S6 | 0.85 | 1573 | 130 | 278 | 48.5 | 0.246 | 1.25 | 93 | 0.5 | 1.4 | 139 | 0.26 | yes |
| B10 | S6 | 0.85 | 1573 | 133 | 281 | 47.9 | 0.245 | 1.19 | 87 | 0.6 | 2.2 | 124 | 0.31 | yes |
| B11 | S6 | 0.85 | 1573 | 129 *) | 275 | 48.1 | 0.214 | 0.71 | 65 | 0.3 | 1.1 | 110 | 0.43 | no |
| B12 | S4 | 0.69 | 1551 | 187 | 352 | 38.2 | 0.238 | 1.72 | 70 | 0.8 | 2.2 | 104 | 0.41 | no |

*) In example B11, the flat steel product showed a marked yield point Reh, the value of which is reported here.

What is claimed is:

1. A cold-rolled and recrystallization-annealed flat steel product including a ferritic microstructure, the flat steel product comprising:

0.002% by weight or less C;

001% - 0.025% by weight Si;

05% - 0.20% by weight Mn;

001% - 0.015% by weight P;

02% - 0.055% by weight Al;

002% by weight or less Nb;

01% - 0.1% by weight Ti; and a remainder being iron and unavoidable impurities, wherein the flat steel product has a yield strength Rp0.2 of up to 180 MPa, a tensile strength Rm of up to 340 MPa, an elongation at break A80 of at least 40%, an n value of at least 0.23, and, on at least one surface, an arithmetic mean roughness Ra of 0.8-1.6 μm and a peak count RPc of at least 75 1/cm, wherein depressions and peaks shaped into the at least one surface that account for the arithmetic mean roughness Ra and the peak count RPc are in stochastic distribution.

2. The cold-rolled and recrystallization-annealed flat steel product of claim 1 wherein the flat steel product further comprises at least one element selected from the group consisting of 001% - 0.05% by weight Cr;

up to 0.005% by weight V;

up to 0.015% by weight Mo; and 0.001% - 0.004% by weight N.

3. The cold-rolled and recrystallization-annealed flat steel product of claim 1 further comprising a metallic protective layer applied by electrolytic coating.

4. The cold-rolled and recrystallization-annealed flat steel product of claim 1 further comprising an inorganic coating.

5. The cold-rolled and recrystallization-annealed flat steel product of claim 1, wherein the flat steel product has a thickness of not more than 1 mm and a width of at least 1000 mm.

6. A method of producing a flat steel product, the method comprising:

providing a roll-hardened, cold-rolled flat steel product having a ferritic microstructure, the flat steel product comprising:

0.002% by weight or less C;

0.001% - 0.025% by weight Si;

0.05% - 0.20% by weight Mn;

0.001% - 0.015% by weight P;

0.02% - 0.055% by weight Al;

0.002% by weight or less Nb;

0.01% - 0.1% by weight Ti; and a remainder being iron and unavoidable impurities;

heat treating the flat steel product in a continuous run through an annealing furnace under an annealing atmosphere at a dew point of −10° C. to −60° C., the annealing atmosphere comprising 1%-7% by volume of hydrogen, with a remainder being nitrogen and unavoidable impurities, wherein the flat steel product is heated up to a hold temperature T1 of 750-860° C. and is kept at the hold temperature T1 for a period t1 of 30-90 s, wherein the flat steel product is cooled from the hold temperature T1 at a cooling rate CR1 of 2-100° C./s to an overaging start temperature T2 of 400-600° C. and after cooling to the overaging start temperature T2 is cooled over a period t2 of 30-400 s at a cooling rate CR2 of 0.5-12° C./s to an overaging end temperature T3 of 250-350° C., and wherein the flat steel product after cooling to the overaging end temperature T3 is cooled at a cooling rate CR3 of 1.5-5.0° C./s to a room temperature; and temper rolling the flat steel product with a temper reduction D of 0.4-0.7% using a working temper roll having a circumferential area that comes into contact with the flat steel product having an arithmetic mean roughness Ra of 1.0-2.5 μm and a peak count RPc of at least 100 1/cm, wherein depressions and peaks shaped into a surface of the working temper roll that account for the arithmetic mean roughness Ra and the peak count RPc are in stochastic distribution.

7. The method of claim 6 wherein the flat steel product further comprises at least one element selected from the group consisting of 0.001% - 0.05% by weight Cr, up to 0.005% by weight V, up to 0.015% by weight Mo, and 0.001% - 0.004% by weight N.

8. The method of claim 6 wherein the flat steel product has a yield strength Rp0.2 of up to 180 MPa, a tensile strength Rm of up to 340 MPa, an elongation at break A80 of at least 40%, and an n value of at least 0.23.

9. The method of claim 6 wherein the hold temperature T1 is 800-850° C.

10. The method of claim 6 wherein the overaging start temperature T2 is 400-550° C.

11. The method of claim 6 wherein the dew point of the annealing atmosphere is −15° C. to −50° C.

12. The method of claim 6 wherein the temper rolling is performed as wet temper rolling such that upstream of the working temper roll in a conveying direction of the flat steel product, a temper rolling fluid is applied to at least a surface of the flat steel product on which the working temper roll acts.

13. The method of claim 6 wherein the temper reduction D is 0.5% -0.6%.

14. The method of claim 6 wherein the arithmetic mean roughness Ra of the circumferential area of the working temper roll that comes into contact with the flat steel product is 1.2 - 2.3 μm.

15. The method of claim 6 wherein the peak count RPc of the circumferential area of the working temper roll that comes into contact with the flat steel product is at least 130 1/cm.

16. The method of claim 6 wherein the temper rolling is performed directly after the heat treating.

17. The method of claim 6 further comprising covering the flat steel product with a metallic coating based on Zn after the temper rolling.

18. The method of claim 17 wherein the metallic coating is applied to the flat steel product by electrolytic galvanization.

* * * * *